United States Patent [19]

Franzén et al.

[11] Patent Number: 4,846,071

[45] Date of Patent: Jul. 11, 1989

[54] BASE-BLEED GAS GENERATOR FOR A PROJECTILE, SHELL OR THE LIKE

[75] Inventors: Arne Franzén; Villy Johansson, both of Karlskoga, Sweden

[73] Assignee: Aktiebolaget Bofors, Bofors, Sweden

[21] Appl. No.: 154,261

[22] Filed: Feb. 10, 1988

[30] Foreign Application Priority Data

Feb. 10, 1987 [SE] Sweden ..... 8700491

[51] Int. Cl.[4] ..... F42B 13/267

[52] U.S. Cl. ..... 102/490; 102/374; 102/501

[58] Field of Search ..... 60/254, 255; 102/490, 102/501, 374, 376, 381, 513

[56] References Cited

U.S. PATENT DOCUMENTS

| | | | |
|---|---|---|---|
| 3,628,457 | 12/1971 | Magnusson et al. | 102/374 |
| 3,698,321 | 10/1972 | Wall | 60/255 |
| 3,972,291 | 8/1976 | Braun, Jr. et al. | 102/513 |
| 4,133,265 | 1/1979 | Diesinger et al. | 102/374 |
| 4,213,393 | 7/1980 | Gunners et al. | 102/374 |
| 4,554,872 | 11/1985 | Schleicher | 102/490 |

FOREIGN PATENT DOCUMENTS

| | | | |
|---|---|---|---|
| 0180515 | 10/1985 | European Pat. Off. . | |
| WO86/05581 | 9/1986 | PCT Int'l Appl. . | |
| 124185 | 3/1949 | Sweden | 102/374 |

*Primary Examiner*—Harold J. Tudor

*Attorney, Agent, or Firm*—Pollock, Vande Sande & Priddy

[57] ABSTRACT

A supporting cupola is provided for the propellant of a base-bleed gas generator for a projectile, shell or the like. The supporting cupola is arranged in the discharge aperture of the gas generator and provides a reduced gas outlet area from the base-bleed combustion chamber during launch of the projectile. The supporting cupola is made of a material which is easily eroded by the hot combustion gases, such as magnesium. The reduced outlet area increases the pressure in the combustion chamber during the acceleration stage of the projectile so that an improved ignition of the propellant and reduced risk of extinguishment is obtained. Due to erosion of the cupola material the outlet opening area increases with time providing a regressive burning rate of the propellant which means an increased base-bleed effect with respect to the firing range of the projectiles.

11 Claims, 1 Drawing Sheet

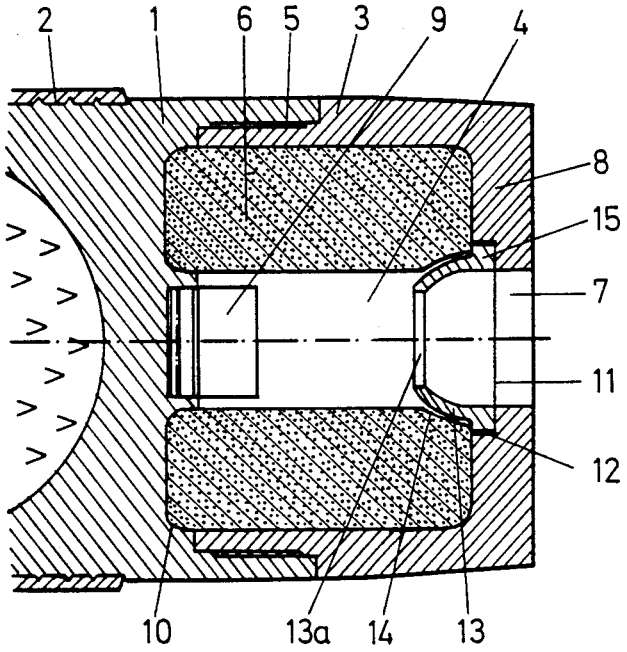
2
1
6
5
3
9
4
8
15
7
11
12
10
13a
14
13

BASE-BLEED GAS GENERATOR FOR A PROJECTILE, SHELL OR THE LIKE

BACKGROUND OF THE INVENTION

The present invention relates to a base-bleed gas generator for the rear part of a projectile, shell or the like.

It is previously known to increase the range of, for instance, artillery projectiles by reducing the base drag of the projectile by means of a suitable base flow, that is to say a combustion gas is ejected from the base surface of the projectile. This has the effect that the low-pressure area behind the projectile is filled up by the gases and the base drag is reduced. In contrast to a reatile, the gas flow velocity is very low and the base flow should occur during a substantial part of the flight time of the projectile.

In order to utilize this base-bleed effect, it is previously known to provide the rear part of the projectile with a tubular base-bleed housing comprising a combustion chamber containing an annularly shaped propellant having a comparatively low burning rate, and a central, comparatively large discharge aperture in the base wall of the combustion chamber for the combustion gases. The base-bleed propellant is preferably a composite propellant composed of polybutadiene as binder (fuel) and ammonium perchlorate as an oxidant.

The base-bleed propellant is ignited by the hot combustion gases generated in the gun tube on the launching of the projectile or the like and flowing into the combustion chamber. The propellant may be extinguished, however, due to the steep pressure drop in the combustion chamber when the projectile leaves the muzzle. For this reason an igniter is usually arranged in the gas generator to prevent such extinguishment during the pressure drop in the combustion chamber.

SUMMARY OF THE INVENTION

The object of the present invention is to improve the structure of a base-bleed gas generator of this type. Even if there is used a composite propellant having a comparatively high elasticity and good strength properties, it has been found in practice that the strength properties in particular cases are insufficient and that there is a risk of breaks and crack formations in the propellant, for instance when firing at a high temperature and high pressure. Furthermore the strength properties of a composite propellant are reduced if the propellant becomes wet, which may happen, for instance, after a long storage time.

The base-bleed gas generator in accordance with the present invention comprises a tubular housing with a combustion chamber containing a base-bleed propellant and a discharge aperture in the base wall of the combustion chamber, for discharge of the combustion gases formed on ignition of the propellant. The discharge aperture is provided with means for supporting the propellant, propellant-supporting means also serving to reduce the area of discharge aperture during the initial stages of the projectile flight.

By means of the present invention the risk of crack formations in the composite propellant, as well as the risk of extinguishment of the propellant when the projectile leaves the muzzle, are both reduced. Through the provision of the apparatus according to the present invention an efficient ignition of the propellant is improved, specifically by reducing the area of the discharge aperture relative to the burning area of the propellant in the initial stage of the projectile flight. In order to obtain a regressive burning rate of the propellant, for an increased base-bleed effect with respect to the range of the projectile, the area of the discharge aperture relative to the burning area is thereafter increased.

According to a preferred embodiment of the present invention, the supporting means for the propellant comprises a cupola-shaped ring made of a light material which is easily eroded by the hot combustion gases.

BRIEF DESCRIPTION OF THE DRAWING

A preferred embodiment of the apparatus of this invention will now be described in more detail with reference to the accompanying drawing which illustrates a longitudinal section through the rear portion of a projectile fitted with a base-bleed gas generator according to the invention.

DETAILED DESCRIPTION OF THE PREFERRED EMBODIMENT(S)

The drawing shows the rear portion of the projectile body 1 with a driving band 2 and an additional rear tubular housing 3 providing a combustion chamber 4. The housing 3 is joined to the projectile body 1 by means of screw threads 5. The projectile body 1 is made for example of steel while the tubular housing 3 is preferably made of a light metal, such as aluminium alloy.

The combustion chamber 4 comprises an annularly shaped propellant 6 of a slowly burning composite powder type which suitably consists of polybutadiene and ammonium perchlorate. The combustion chamber is provided with a central discharge aperture or nozzle outlet 7 for the combustion gases in the bottom or rear part 8 of the base-bleed housing. To assure an immediate re-ignition of the propellant 6 if it is extinguished when the projectile leaves the muzzle of the gun, the combustion chamber 4 is provided with a pyrotechnic igniter 9 arranged in the base wall of the projectile body. The igniter preferably consists of a pyrotechnic composition which is substantially insensitive to pressure variations. The pyrotechnic composition is ignited at the same time as the propellant 6 by the combustion gases in the gun barrel when firing the gun and it is not extinguished by the steep pressure drop when the projectile leaves the muzzle.

The propellant 6 is subject to high mechanical stresses due to the high acceleration of the projectile during launch and also due to the high rotation of the projectile. The rear surface of the projectile body is provided with a rounded, annular groove 10 for receiving the forward part of the propellant. The rear end of the propellant is retained in place by the base wall 8 of the base-bleed housing.

In order to reduce the stresses on the propellant the base wall 8 is provided with supporting means in the form of a cupola-shaped supporting ring 11 joined to the base wall 8 by a screw thread 12 arranged in a circular recess in the wall.

The cupola-shaped spherical surface 13 of the ring 11 supports the rear portion of the propellant. The cylindrical inner surface of the tubular propellant is then preferably adapted to the spherical form of the cupola, as indicated by reference numeral 14. Forming the supporting ring with a spherical wall provides the optimum ratio between the strength and weight of the ring.

The supporting ring 11 is provided with a flange 15 arranged in a corresponding annular recess 12 in the base wall 8. The inner diameter of the rear part of the supporting ring flange 15 is adapted to the nozzle outlet diameter of the base wall, while the forward part of the cupola-shaped portion of the ring is provided with an opening 13*a* having a smaller diameter to provide the desired reduced discharge aperture diameter during launch of the projectile. The provision of the reduced discharge aperture at the initial stage of the flight, such as during the acceleration of the projectile, is advantageous as the pressure in the combustion chamber is increased and thereby the ignition of the propellant is improved. Furthermore, the pressure drop in the combustion chamber when the projectile leaves the muzzle is also reduced, so that the risk of extinguishment especially when firing "cold" shots, is minimized.

After the acceleration phase, however, it is an advantage if the outlet area again has a more conventional increased size. The supporting cupola ring is therefore preferably made of a material, for instance magnesium, which is eroded under the influence of the hot combustion gases. Magnesium is easily eroded by the hot gases so that the cupola of the supporting ring is completely eroded in a short time, typically within approximately two seconds. After the erosion of the cupola the inner surface of the remaining supporting ring corresponds to the size of the discharge aperture 7. The increase of the outlet area as a function of time means a regressive burning rate of the propellant, which in turn means an increased base-bleed effect with respect to the range of the projectile. However, the outlet area should not be too small initially so that sonic speed is not reached in the nozzle, because then the base-bleed effect is reduced. For an artillery projectile of 150 mm, for example, the normal outlet nozzle diameter is suitably within the range of 40–45 mm while the diameter of the cupola opening 13*a* is suitably within the range of 10–35 mm.

There is a further advantage in using magnesium in the supporting ring. Magnesium has itself an igniting effect, so that when the hot gun combustion gases flow into the combustion chamber during launch, glowing magnesium particles are carried away from the ring into the combustion chamber to function as local firing start points for ignition of the base-bleed propellant.

In addition to the above characteristics of magnesium, for example that it is easily eroded and has an igniting effect, this material is light, which is also an advantage. However, other materials can also be used for the supporting cupola ring, such as aluminium alloys or glass or carbon-fiber reinforced plastics. In case of an aluminium alloy the supporting cupola ring may be formed integrally with the base-bleed housing. In this case the separate joining of the cupola ring to the base-bleed housing is eliminated and the mounting procedure is facilitated.

It should also be mentioned that proving tests have indicated that the igniter 9 in the base-bleed generator may be replaced by a supporting cupola ring of suitable design and material.

What we claim is:

1. A base-bleed gas generator for the rear part of a projectile, said gas generator comprising:

a tubular housing having a base wall and side walls extending therefrom and defining a combustion chamber therein;

a base-bleed propellant provided in said combustion chamber;

a discharge outlet formed in said base wall for discharge of the combustion gases formed on ignition of said propellant;

a propellant-supporting member mounted in said base wall and having a portion defining an aperture substantially aligned with said discharge outlet and having a diameter smaller than the diameter of said discharge outlet;

at least said portion of said propellant-supporting member defining said aperture being made of a material erodible by combustion gases whereby after the initial acceleration phase, the diameter of said aperture due to erosion increases to substantially correspond to said discharge outlet diameter.

2. A base-bleed gas generator according to claim 1, wherein said base-bleed propellant is of substantially cylindrical annular shape and wherein said propellant-supporting member comprises a ring which supports a rear part of the inner cylindrical surface of said propellant.

3. A base-bleed gas generator according to claim 2, wherein said discharge outlet is cylindrical, and wherein said supporting ring comprises a flange with a screw thread for mounting said ring in a corresponding recess in the cylindrical inner surface of said discharge outlet.

4. A base-bleed gas generator according to claim 2 wherein said ring comprises a spherical, cupola-shaped part forming a supporting surface for said propellant.

5. A base-bleed gas generator according to claim 4, wherein the cupola-shaped ring is made of magnesium.

6. A base-bleed gas generator for the rear part of a projectile, said gas generator comprising:

a tubular housing having a base wall and side walls extending therefrom and defining a combustion chamber therein;

a base-bleed propellant provided in said combustion chamber, said propellant being of generally cylindrical annular shape;

a discharge outlet formed in said base wall for discharge of the combustion gases formed on ignition of said propellant; and a propellant-supporting means provided in said base wall at said discharge outlet for supporting said propellant, said propellant supporting means including means for reducing the area of said discharge outlet during the initial stage of the projectile flight; and said propellant-supporting member comprising a ring which supports a rear part of the inner cylindrical surface of said propellant;

said ring including a spherical, cupola-shaped part forming a supporting surface for said propellant.

7. A base-bleed gas generator according to claim 6, wherein said cupola-shaped part of said ring is provided with an aperture having a diameter which is less than the diameter of the discharge outlet in said base wall of said combustion chamber.

8. A base-bleed gas generator according to claim 6, wherein at least the cupola-shaped part of the supporting ring is made of a material erodible by the combustion gases.

9. A base-bleed gas generator according to claim 7, wherein at least the cupola-shaped part of the supporting ring is made of a material erodible by the combustion gases.

10. A base-bleed gas generator according to claim 8, wherein the cupola-shaped ring is made of magnesium.

11. A base-bleed gas generator according to claim 9, wherein the cupola-shaped ring is made of magnesium.

* * * * *